US005639388A

United States Patent [19]

Kimura et al.

[11] Patent Number: 5,639,388

[45] Date of Patent: Jun. 17, 1997

[54] POLISHING ENDPOINT DETECTION METHOD

[75] Inventors: Norio Kimura, Fujisawa; Fumihiko Sakata, Yokohama; Tamami Takahashi, Yamato, all of Japan

[73] Assignee: Ebara Corporation, Tokyo, Japan

[21] Appl. No.: 588,241

[22] Filed: Jan. 18, 1996

[30] Foreign Application Priority Data

Jan. 19, 1995 [JP] Japan ..... 7-024812

[51] Int. Cl.[6] ..... H01L 21/66; B24B 49/16

[52] U.S. Cl. ..... 216/84; 216/88; 156/626.1; 156/645.1; 156/636.1; 451/41; 437/8; 437/225

[58] Field of Search ..... 156/636.1, 645.1, 156/626.1; 216/84, 88, 89

[56] References Cited

U.S. PATENT DOCUMENTS 4,910,155 3/1990 Cote et al. .
5,036,015 7/1991 Sandhu et al. ..... 437/8
5,069,002 12/1991 Sandhu et al. ..... 51/165 R
5,232,875 8/1993 Tuttle et al. ..... 437/225
5,308,438 5/1994 Cote et al. .

OTHER PUBLICATIONS

IBM Technical Disclosure Bulletin, vol. 31, No. 4, J.D. Warnock, Sep. 1988 "End Point Detector For Chemi-Mechanical Polisher".

*Primary Examiner*—R. Bruce Breneman
*Assistant Examiner*—Michael E. Adjodha
*Attorney, Agent, or Firm*—Wenderoth, Lind & Ponack

[57] ABSTRACT

An endpoint detection in a polishing process of a polishing object which has a first layer and a second layer, formed under the first layer, is performed by holding the polishing object on a top ring and pressing a surface of the first layer of the polishing object onto a polishing cloth mounted on a rotating turntable so as to remove the first layer, oscillating the top ring in contact with the turntable, periodically measuring a torque on the rotating turntable when the top ring is positioned at a specific radial location defined by a radius from a rotational center of the turntable, and determining the endpoint based on a change in the torque generated when the first layer is removed and the second layer comes into contact with the polishing cloth.

9 Claims, 8 Drawing Sheets

POLISHING ENDPOINT DETECTION METHOD

BACKGROUND OF THE INVENTION

1. Field of the Invention

The present invention relates in general to polishing of materials, and relates in particular to a method of determining an endpoint in a polishing process to provide a flat mirror polished surface on objects having fine internal structures such as semiconductor wafers.

2. Description of the Related Art

High density integrated semiconductor devices of recent years require increasingly finer microcircuits, and the interline spacing has also shown a steadily decreasing trend. For optical lithography operations based on less than 0.5 micrometer interline spacing, the depth of focus is shallow and high precision in flatness is required on the polishing object which has to be coincident with the focusing plane of the stepper.

Therefore, it is necessary to make the surface of a semiconductor wafer flat before fine circuit interconnections are formed thereon. According to one customary process, semiconductor wafers are polished to a flat finish by a polishing apparatus.

One conventional polishing apparatus comprises a turntable with a polishing cloth attached to its upper surface and a top ring disposed in confronting relationship to the upper surface of the turntable, the turntable and the top ring being rotatable at respective independent speeds. The top ring is pressed against the turntable to impart a certain pressure to an object which is interposed between the polishing cloth and the top ring. While an abrasive liquid containing abrasive material is supplied onto the upper surface of the polishing cloth, the surface of the object is polished to a flat mirror finish by the polishing cloth which has the abrasive material thereon, during relative rotation of the top ring and the turntable.

A device for detecting an endpoint of the polishing process which is used in the conventional polishing apparatus is disclosed in, for example, a U.S. Pat. No. 5,036,015. In the U.S. Pat. No. 5,036,015, a wafer to be polished is a multilayer material comprising a semiconductor layer, a conductor layer and an insulator layer. The frictional force between the polishing cloth and the wafer changes during a polishing process, as a surface layer is removed and an underlayer of the surface layer becomes exposed. According to this method, an endpoint is detected when a different underlayer becomes exposed.

A change in the frictional force is detected as follows. The wafer is polished at some distance away from the center of rotation of the turntable so that the point of application of the frictional force is eccentric, and this eccentricity causes a torque load on the turntable. When the turntable is driven with an electric motor, the torque can be measured as a function of the current flowing through the motor. Therefore, by monitoring the current, and suitably processing the resulting signal, it is possible to detect an endpoint as a change in the current measured.

In this type of conventional polishing apparatus, the top, ring holding the wafer is oscillated on the polishing cloth, in addition to the rotational motion of the top ring. The purpose of oscillation of the top ring is not only to prevent local wear of the polishing cloth and prolong the service life of the polishing cloth but also to prevent degradation in the flatness of the wafer caused by localized use of the polishing cloth.

However, such oscillating motions present a problem in detecting an endpoint from measurements of changes in the torque. This is because the point of application of the frictional force changes as the top ring is oscillated, and thus the torque applied to the turntable changes with the point of application of the frictional force. That is, since the torque is represented as a product of a frictional force and a distance from a center of the turntable to the point of application of the frictional force, the torque is affected by the change of the distance. Therefore, even if the torque is detected, the frictional force cannot be determined.

SUMMARY OF THE INVENTION

It is an object of the present invention to provide a method for detecting an endpoint, in a polishing process of a polishing object having a multilayer structure, so that an oscillating motion of a top ring would not interfere with the process of uniquely determining when a first layer is removed and a second layer formed under the first layer comes into contact with the polishing cloth to cause a change in torque applied to the turntable.

The object has been achieved in a method for detecting an endpoint in a polishing process of a polishing object comprising multilayers of different materials having at least a first layer and a second layer formed under the first layer, the endpoint being reached when the second layer becomes exposed at a polishing surface, comprising the steps of: holding the polishing object on a top ring and pressing a surface of the first layer of the polishing object onto a polishing cloth mounted on a rotating turntable so as to remove the first layer; oscillating the top ring in contact with the turntable; periodically measuring a torque on the rotating turntable when the top ring is positioned at a specific radial location defined by a radius from a rotational center of the turntable; and determining the endpoint based on a change in the torque generated when the first layer is removed and the second layer comes into contact with the polishing cloth.

According to this method, torque measurements are taken intermittently when the top ring is positioned at the same radial location on the turntable defined by a radius from the center of the turntable, so that the effects of changes in top ring position on torque measurements obtained by the current measurements in the turntable driving motor can be eliminated.

An aspect of the method is that the specific radial location is defined at a plurality of radial locations.

By providing several locations for measurements, early warning of an endpoint can be attained, as more measurements can be performed. This provision also prevents missing an endpoint because of a failed measurement at one location.

Another aspect of the method is that the torque is measured when the frictional force is operative in a same direction as a direction of rotation of the rotating turntable.

Another aspect of the method is that the torque is measured when the frictional force is operative in an opposite direction to a direction of rotation of the rotating turntable.

These aspects of the method assure that by separating the current measurements into two cases, it is possible to ignore changes in torque accompanying the oscillating motion.

The final aspect of the method is that the torque is measured while stopping an oscillating motion of the top ring.

This aspect of the method provides a way of determining an endpoint without having to consider the effect of the direction of movement of the top ring on torque measurements.

DESCRIPTION OF THE PREFERRED EMBODIMENTS

Figure 1:
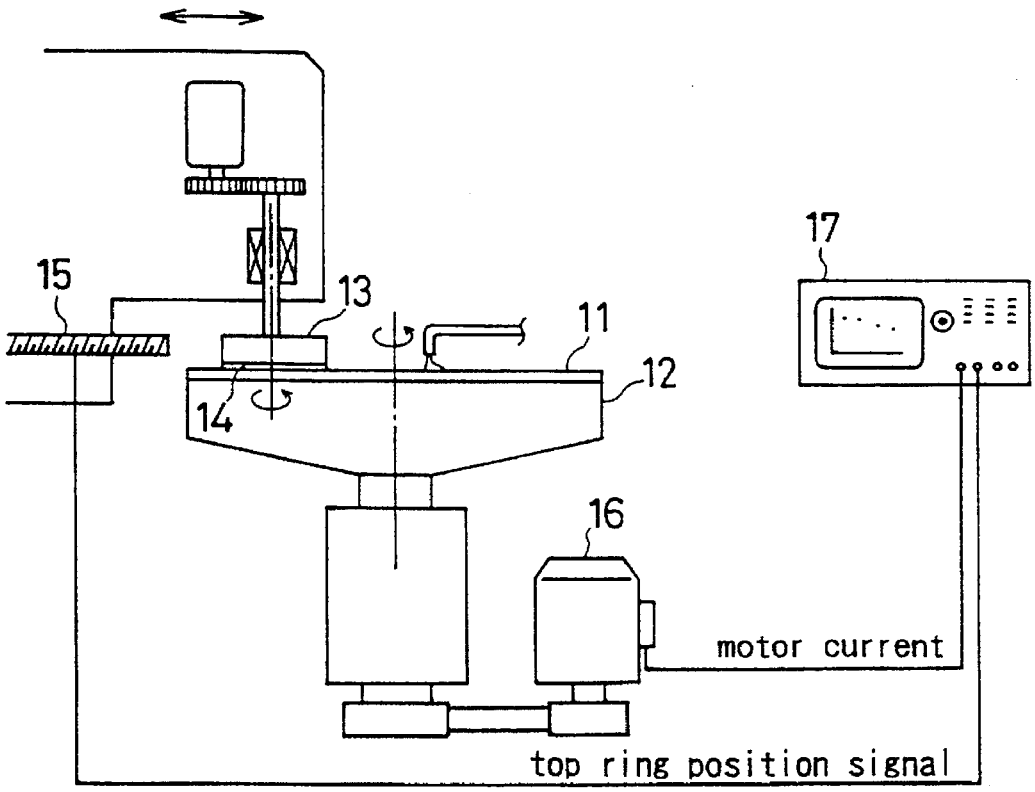
FIG. 1 is a schematic overall view of a polishing apparatus utilized in the present invention.

An embodiment of the process of detecting an endpoint in polishing will be presented with reference to FIGS. 1 to 9. FIG. 1 is an overall view of the polishing apparatus comprising: a turntable 12; a top ring 13 for holding a wafer 14; an oscillating device 15 for producing an oscillating motion of the top ring 13 on the turntable 12; a signal processing device 17 for processing the current signal from the motor 16 for driving the turntable 12.

The operation of the polishing action using the polishing apparatus will be explained. The turntable 12 having a polishing cloth 11 mounted on its top surface is rotated by means of a drive belt connected to the motor 16. The top ring 13 holds the wafer 14 to be polished and presses the wafer down onto the polishing cloth 11, and rotates about an axis which is located eccentrically with respect to the center of rotation of the turntable, as shown in FIG. 1. During polishing of the wafer 14, a polishing solution is supplied onto the cloth 11.

The top ring 13 is made to undergo an oscillating motion by the oscillating device 15 so that a wide area of the polishing cloth 11 is utilized to minimize localized wear of the cloth 11 thereby prolonging its service life. Another purpose is to prevent degradation in the flatness of the wafer caused by localized wear.

The signal processing device 17 is provided to determine the current flowing in the motor 16, position signals for the top ring 13, and an endpoint for a polishing step.

Figure 2:
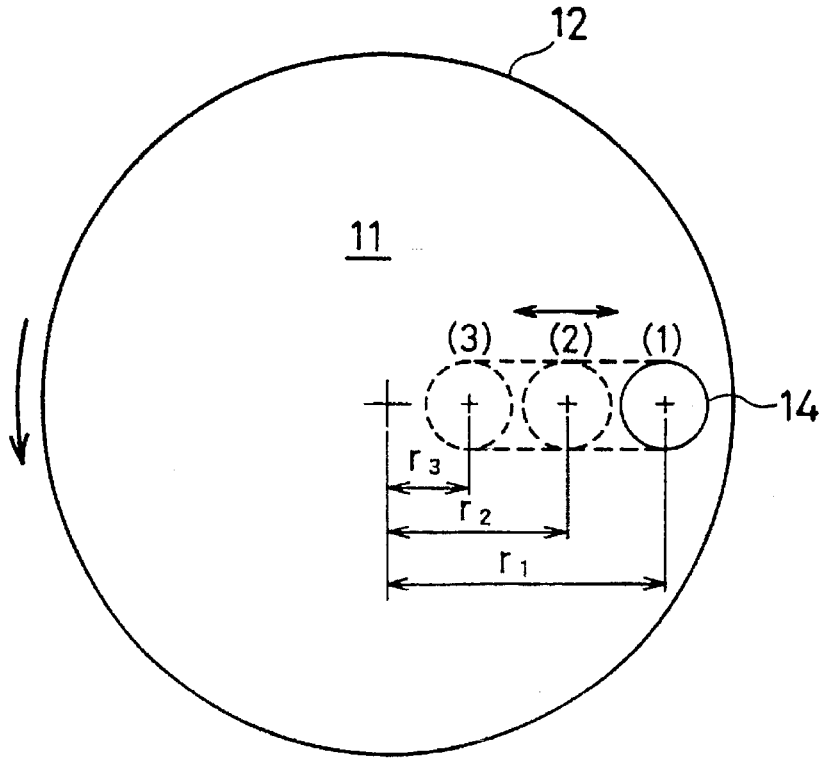
FIG. 2 is a view of the three radial locations on the top surface of the turntable.

The oscillating motion of the top ring will be explained with reference to FIG. 2. The wafer 14 held in the top ring 13 is subjected to a cycle of radial oscillating motion from location (1) through location (2) to location (3) and back to locations (2) and (1), as illustrated in FIG. 2, by the action of the oscillating device 15.

Figure 3:
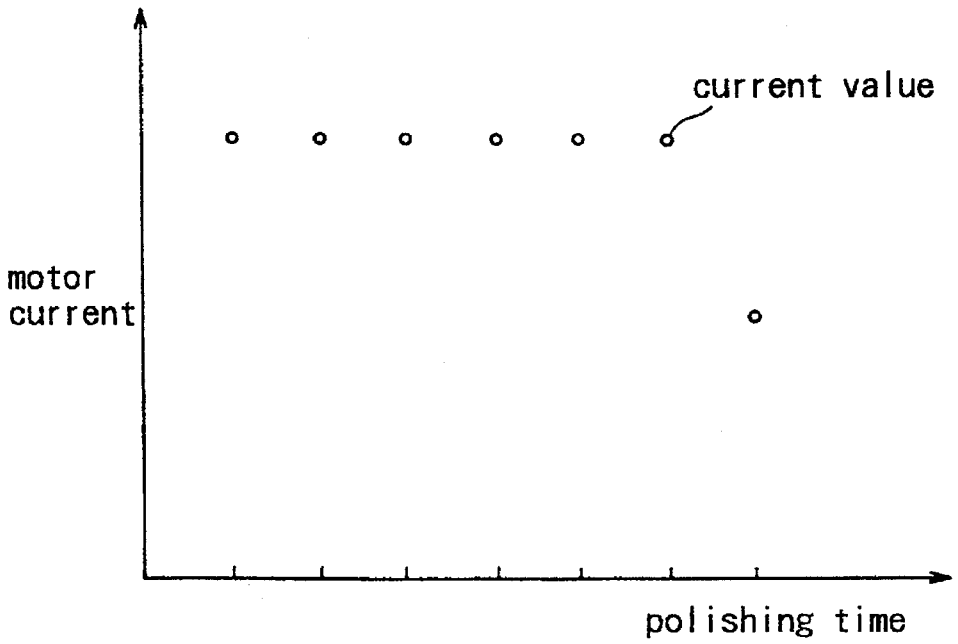
FIG. 3 is a graph showing measured data of current flowing in the motor as a function of polishing time.

During an oscillation cycle, the current flowing in the motor 16 is monitored each time when the top ring is positioned at the same radius position within the turntable. For example, monitoring is performed when the center of rotation of the top ring 13 is at a radius $r_1$ away from the center of rotation of the turntable 12. It follows that each measurement is discrete and is made on a periodic schedule. The variation in the results of discrete measurements with polishing time is illustrated in FIG. 3.

Figure 4A:
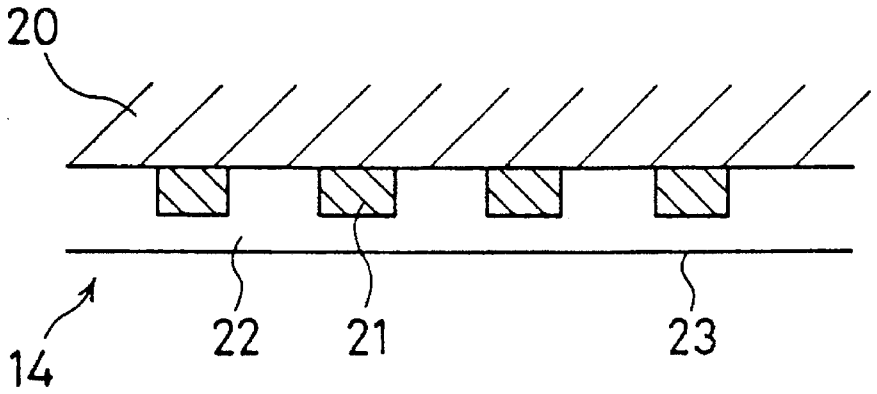
FIG. 4A is an enlarged cross sectional view of a fabricated wafer which has a first layer and a second layer formed under the first layer before polishing.
Figure 4B:
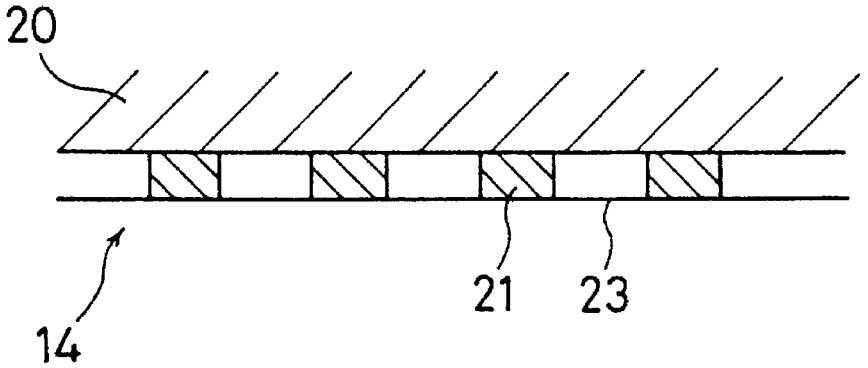
FIG. 4B is an enlarged cross sectional view of a fabricated wafer after removal of the first layer.

FIGS. 4A and 4B show schematic enlarged views of a surface to be polished represented by a polishing surface 23 of a semiconductor wafer 14. This wafer 14 comprises a silicon substrate 20 with metal interconnect lines 21 and an insulation layer of silicon dioxide 22 formed on the substrate 20. The insulation layer of silicon dioxide 22 constitutes a first layer, and the silicon substrate 20 with the metal interconnect lines 21 constitutes a second layer. FIG. 4A represents the wafer 14 before polishing and FIG. 4B represents the condition of the wafer 14 after polishing when the insulation layer 22 is removed and the polishing surface 23 becomes coincident with the surface of the metal interconnect lines 21. As the forelayer of the insulation layer 22 is removed by polishing, the polishing surface 23 gradually recedes to the surfaces of the metal lines 21. The frictional coefficient of the two materials (insulation and metal) are different, and this differences due to difference in the characteristics of the material being polished becomes manifested in changes in the frictional forces acting on the turntable.

Figure 5:
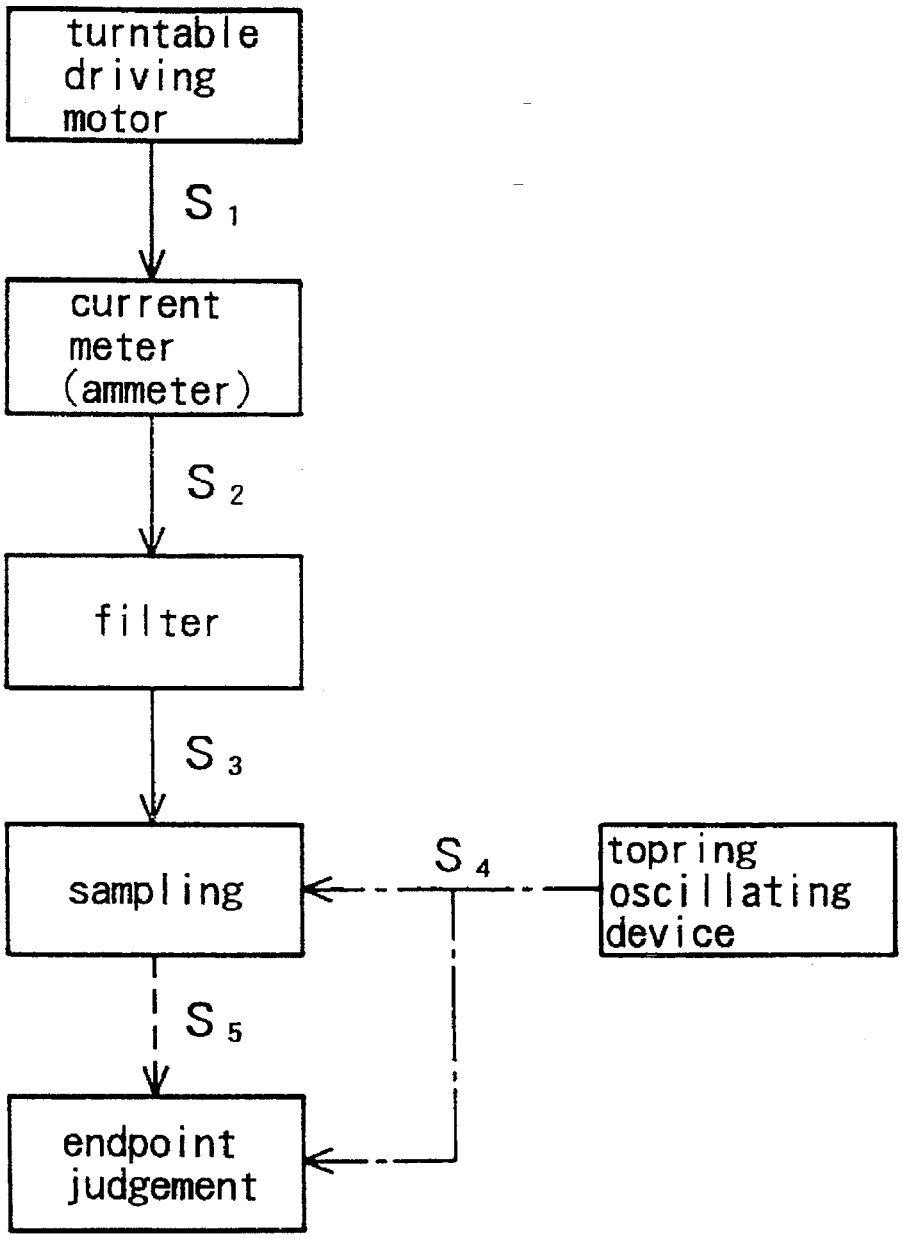
FIG. 5 is a flowchart for a current measurement process.

FIG. 5 shows a flowchart for detection of the motor current $S_1$ flowing through the motor 16. The motor current $S_1$ measured by an ammeter is converted into a voltage signal $S_2$. The converted voltage signal $S_2$ generally contains noise, comprised of high frequency components, and therefore, it is necessary to filter the signal $S_2$ to eliminate the noise, to obtain a filtered signal $S_3$. The filter used here is a low-pass filter. Next, when the top ring reaches a specific location in a cycle of the oscillating motion, a position signal generation device (provided in the oscillating device 15) generates a position signal $S_4$, and triggers sampling of a filtered signal $S_3$, which is being monitored continually, to obtain a sampled signal $S_5$. Therefore, all the signals up to the step of obtaining signal $S_3$ are taken continuously, but the sampled signals $S_5$ are discrete signals and are taken intermittently. To generate a position signal $S_4$ during the oscillating motion of the top ring, a limit switch may be used. The position signal $S_4$ is used to determine the time of sampling, as well as to determine the location of the top ring, and for this reason, the position signal $S_4$ is forwarded to the next endpoint judgement step.

Figure 6:
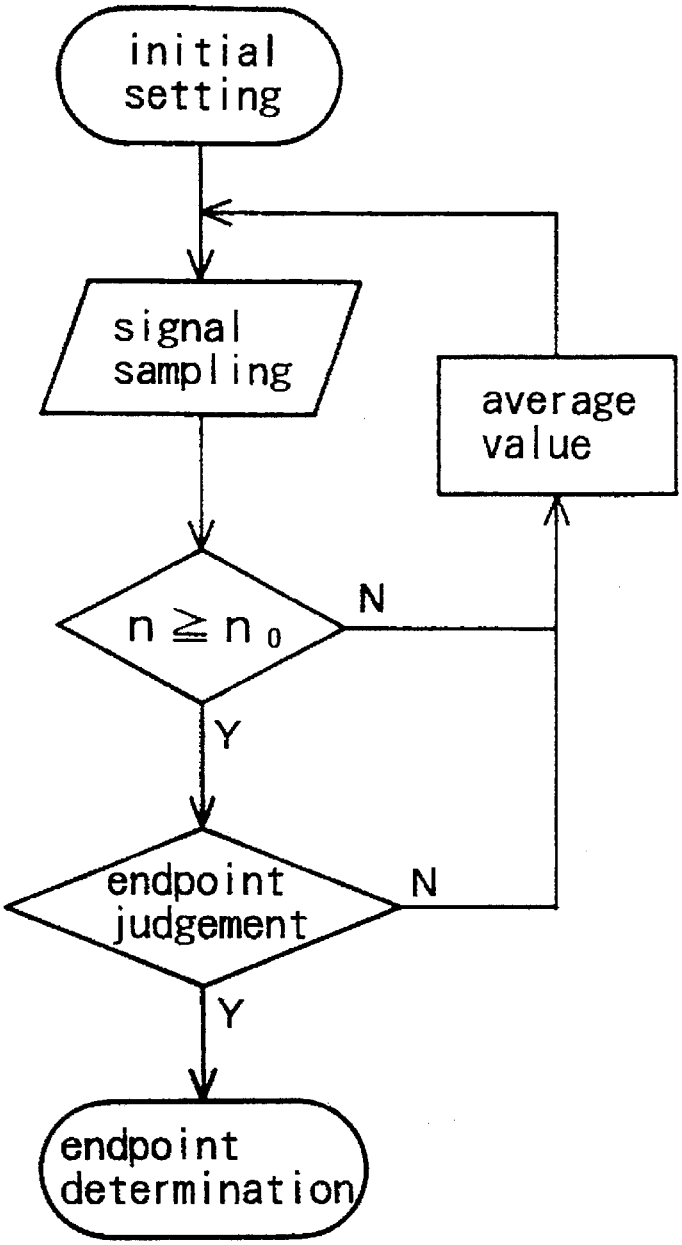
FIG. 6 is a flowchart for an endpoint detection process.

FIG. 6 is a flowchart for the steps required to determine an endpoint, and corresponds to the endpoint judgement step shown in FIG. 5. In step 1, the initializing step, all the variables in the signal processing device 17 are initialized. In step 2, on the basis of a filtered signal $S_3$ which is a signal generated when the top ring is positioned at a specific location in the cycle of the oscillating motion, a sampled signal $S_5$ is taken into the signal processing device 17. In the flowchart, "n" indicates a natural number to be assigned to successive values of sampled data. The sampled signal $S_5$ is compared with an averaged value of the sampled signals $S_5$ obtained in the past cycles. To detect if there is any change, the averaged value to a count $n_0$ is determined in step 3. In step 4, an absolute value of the difference between the current sampled signal $S_5$ and an averaged value $S_5$ of the past $S_5$ data are compared, and if the difference is higher than a specified value, then it is determined that an endpoint has been reached.

In step 4, the endpoint judgement step, if it is determined that an endpoint has been reached, a stop-polish command is sent to a controller (not shown) which controls the overall operation of the polishing apparatus. Accordingly, the controller stops polishing action by shutting down turntable and top ring and other polishing activities of the polishing apparatus.

Another embodiment of the present invention will be explained with reference to FIGS. 2 and 7A–7C which refer to current measurements at three different locations of the top ring in a cycle of oscillating motion.

Figures 7A, 7B, 7C:
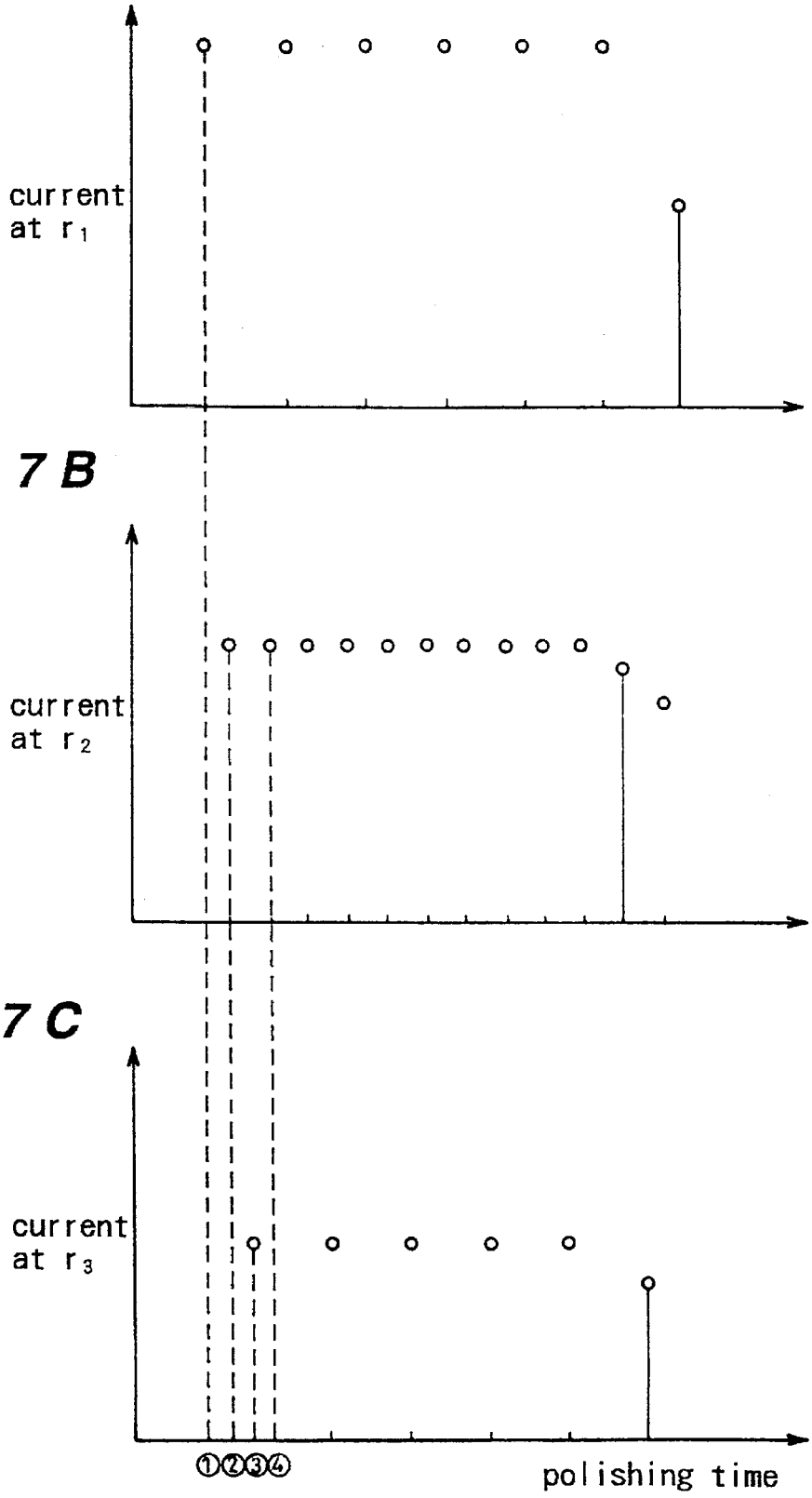
FIG. 7A is a graph showing the current as a function of polishing time at location (1).
FIG. 7B is a graph showing the current as a function of polishing time at location (2).
FIG. 7C is a graph showing the current as a function of polishing time at location (3).

In FIG. 2, the independent current measurements through the motor 16 are taken when the wafer 14 is positioned, at locations (1), (2) and (3), and the measured results are shown in FIGS. 7A, 7B and 7C, respectively. The sequence of measurements is location (1), (2), (3), (2) and back to (1). Discrete measurements are taken at locations which are $r_1$, $r_2$and $r_3$ distance away as illustrated in FIG. 7A, 7B and 7C. The numerals on the x-axis indicate the order of measurements in the sequence. Discrete measurements are needed to eliminate the effect of positional changes (measured from the center of rotation of the turntable) on the friction and torque. Here, it will be noted that at location (2), there are a higher number of measurements because the top ring passes through location (2) twice in each cycle of its oscillating motion compared with only once per cycle for locations (1) and (3). As shown in the graphs, the measurements are taken at different times for each location. Changes in current measurements are assessed independently for each location. The method of determining the change is the same as those described with reference to FIGS. 5 and 6 and involves comparison of current data with an average of the past data.

Figure 8:
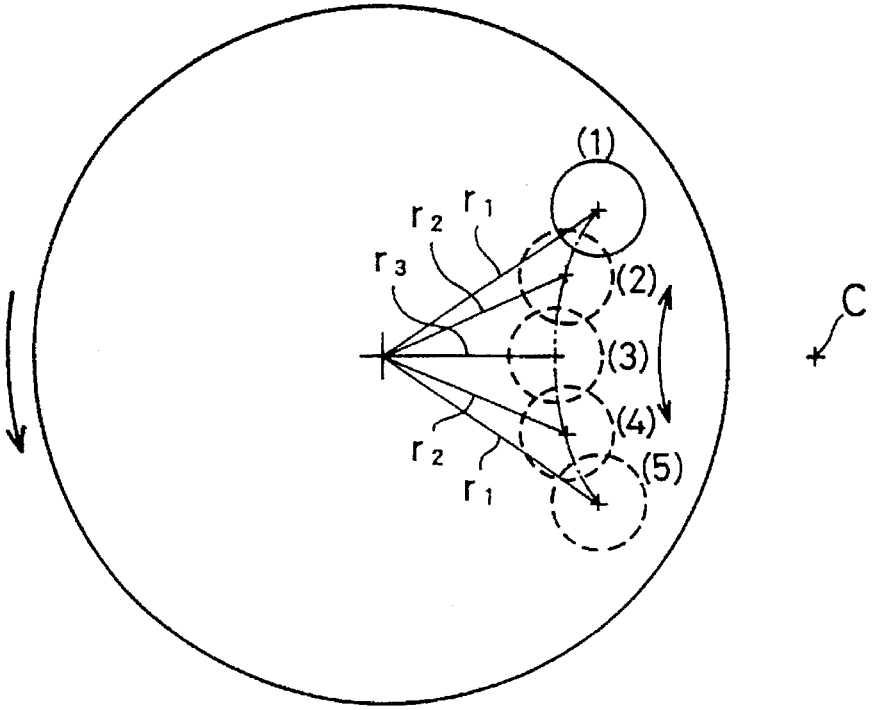
FIG. 8 is an illustration of a type of motion of the top ring.
Figure 9:
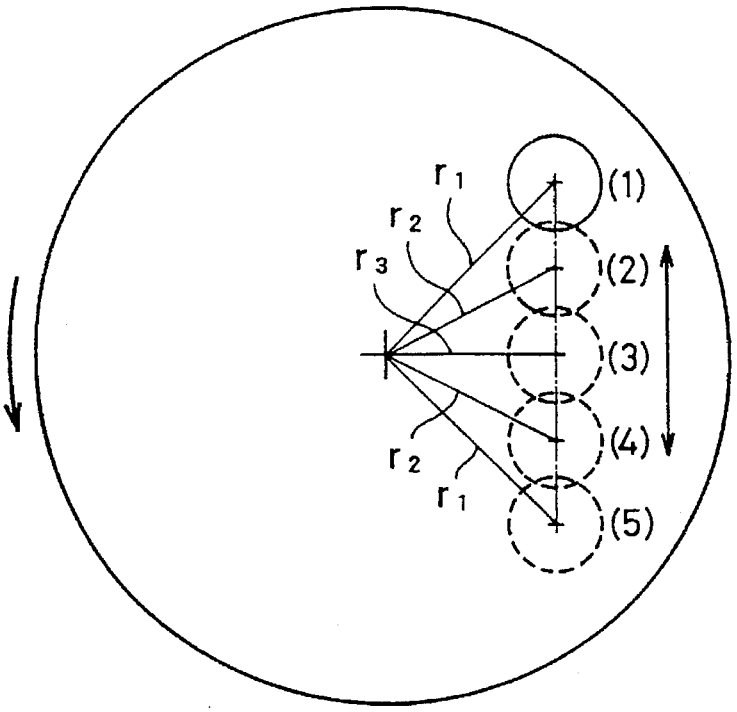
FIG. 9 is an illustration of another type of motion of the top ring.

Still another embodiment of the present invention will be presented with reference to FIGS. 8 and 9. The pattern of motion of the top ring 13, as seen in a top view of the turntable shown in FIG. 8, is different from the oscillating motion presented earlier. In this case, the top ring 13 produces a swinging pattern about a center C. FIG. 9 shows another pattern of oscillating motion, which is at right angles to the radial oscillating motion shown in FIG. 2.

The polishing apparatuses of FIGS. 8 and 9 are different from the polishing apparatus of FIG. 2 in that the direction of oscillating motion of the top ring affects the magnitude of the torque applied to the turntable. Comparing the motions illustrated in FIGS. 2, 8 and 9, when the direction of motion of the top ring crosses the radial direction of the turntable as in FIGS. 8 and 9, even when the top ring 13 is located at the same radial point given by the same distance from the center of rotation of the turntable, the effect of the moving top ring on the torque applied to the turntable is different, depending on the direction of oscillating motion of the top ring in passing through that point. For example, at the location (3) in FIG. 8, the resulting effect of the friction force is different depending on whether the direction of passing of the oscillating top ring is clockwise or counterclockwise (i.e. depending on whether the oscillating motion of the top ring is in the same direction or an opposite direction relative to the rotation of the turntable). The friction force can either aid or oppose the rotation force of the turntable. Therefore, it can be seen that the frictional effects must be viewed as a vector problem, allowing for not only the magnitude of the friction force but also the direction in which that friction force is acting due to the direction of oscillating motion of the top ring.

Therefore, in both FIGS. 8 and 9, even though a point may be located at the same radial distance, when the direction of oscillating motion of the top ring crosses the radial direction of the turntable, it is necessary to process the results separately. Specifically, for signals received in passing locations (2) through to (4), it is necessary to process the data separately for clockwise movement and counterclockwise movement of the top ring. The signals separated for the two directions of movement are processed independently, each result is put through the steps in flowcharts shown in FIGS. 5 and 6 to detect an endpoint for each movement.

The influence on the torque of the turntable caused by the oscillating direction of the top ring will be described below in detail. The frictional force between the semiconductor wafer and the polishing cloth on the turntable is defined as a product of a pressing force acting on the turntable perpendicularly and the coefficient of friction between the semiconductor wafer and the polishing cloth. The torque applied to the turntable is defined as a product of the frictional force and the distance between the center of the turntable and the top ring. The coefficient of viscous friction of the coefficient of friction changes in accordance with the relative velocity between the top ring and the turntable. The relative velocity changes on the basis of the moving direction of the top ring. That is, the relative velocity changes in both cases where the top ring moves in the same direction as the turntable (hereinafter referred to as forward direction) and in the opposite direction to the turntable (hereinafter referred to as opposing direction). As a result, the torques applied to the turntable are different from each other in both cases.

Next, the influence on the torque will be described in cases of the forward direction and the opposing direction.

Figure 10:
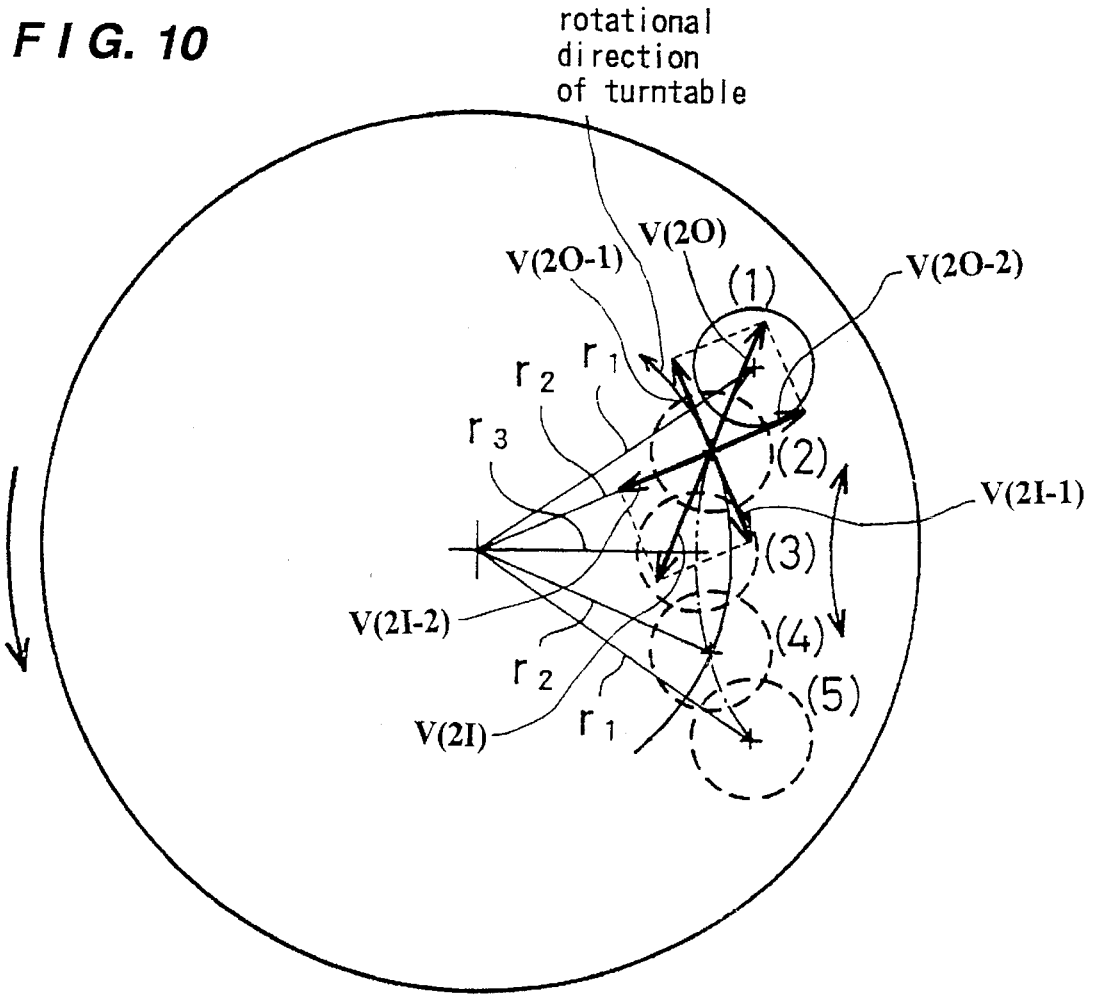
FIG. 10 is an illustration showing velocity vectors in the case where the top ring is located at the location (2) in the embodiment of FIG. 8.

FIG. 10 shows velocity vectors in the case where the top ring is located at the location (2) in the embodiment of FIG. 8. V(2O) represents the velocity vector of the top ring in the case where the top ring moves toward the oscillating end of the top ring, and V(2I) represents the velocity vector of the top ring in the case where the top ring moves toward the oscillating center portion of the top ring. V(2O-1) represents the component of velocity of V(2O) at the location (2) in the rotational direction of the turntable, and V(2O-2) represents the component of velocity of V(2O) at the location (2) in the direction normal to the rotational direction of the turntable. Similarly, V(2I-1) represents the component of velocity of V(2I) at the location (2) in the rotational direction of the turntable, and V(2I-2) represents the component of velocity of V(2I) at the location (2) in the direction normal to the rotational direction of the turntable. Here, the components of velocities which affect the torque applied to the turntable are V(2O-1) and V(2I-1), the relative velocity between the top ring and the turntable is decreased by V(2O-1), and the relative velocity between the top ring and the turntable is increased by V(2I-1). Thus, even if the distance from the center of the turntable to the top ring is the same distance as $r_2$, the value of the torque changes in accordance with the moving direction of the top ring. Therefore, it is necessary to detect an end point in consideration of the moving direction of the top ring.

Another approach to solving the same problem is to stop the oscillating motion of the top ring during the torque measurements, whereby an endpoint can be detected without being affected by the changes of the torque. In this case, the measurement of the motor current is taken continuously while the turntable is rotating, and the results obtained at different locations on the turntable form a set of periodic measurements of changes in the torque which are experienced by the rotating turntable.

Summarizing the advantages offered by the polishing method of the present invention, it is clear that an endpoint of the polishing process can be determined accurately even when the top ring undergoes oscillating motions frequently utilized in conventional polishing processes.

Although the embodiments were described in terms of polishing a semiconductor wafer, it is obvious that the polishing method is applicable generally to any objects requiring a micro-finished surface.

What is claimed is:

1. A method for detecting an endpoint in a polishing process of a polishing object comprising multilayers of different materials having at least a first layer and a second layer formed under said first layer, said endpoint being reached when said second layer becomes exposed at a polishing surface, comprising the steps of:

holding said polishing object on a top ring and pressing a surface of said first layer of said polishing object onto a polishing cloth mounted on a rotating turntable so as to remove said first layer;

oscillating said top ring while in contact with said turntable such that said top ring moves through different radial distances from a rotational center of said turntable;

making discrete measurements of torque on said rotating turntable at different, discrete points in time when said top ring is positioned at a specific radial location defined by a specific one of said different radial distances from said rotational center of said turntable; and determining said endpoint based on a change in said torque generated at said discrete points in time when said first layer is removed and said second layer comes into contact with said polishing cloth.

2. A method as claimed in claim 1, wherein said torque is measured at each of said discrete points in time while stopping an oscillating motion of said top ring.

3. A method as claimed in claim 1, wherein at each of said discrete points in time, the oscillating motion of said top ring has a velocity component in the same direction as a velocity component of the rotation of said turntable.

4. A method as claimed in claim 1, wherein at each of said discrete points in time, the oscillating motion of said top ring has a velocity component opposite in direction to a velocity component of the rotation of said turntable.

5. A method for detecting an endpoint in a polishing process of a polishing object comprising multilayers of different materials having at least a first layer and a second layer formed under said first layer, said endpoint being reached when said second layer becomes exposed at a polishing surface, comprising the steps of:

holding said polishing object on a top ring and pressing a surface of said first layer of said polishing object onto a polishing cloth mounted on a rotating turntable so as to remove said first layer;

oscillating said top ring while in contact with said turntable such that said top ring moves through different radial locations at respectively different radial distances from a rotational center of said turntable;

at discrete points in time, making discrete measurements of torque at each of a plurality of said different radial locations of said top ring relative to said turntable as said top ring is oscillated relative to said turntable; and determining said endpoint based on changes in the torques measured, from one of said discrete points in time to another, at individual ones of said different radial locations, caused when said first layer is removed and said second layer comes into contact with said polishing cloth.

6. A method as claimed in claim 5, wherein said torque is measured at each of said discrete points in time while stopping an oscillating motion of said top ring.

7. A method as claimed in claim 5, wherein said torque measured at a single one of said different radial locations are processed separately depending on a direction of a velocity component of the oscillating motion of said top ring relative to a direction of a velocity component of the rotation of said turntable.

8. A method as claimed in claim 5, wherein at each of said different radial locations, said torque is measured where the direction of a velocity component of the oscillating motion of said top ring is the same as the direction of a velocity component of the rotation of said turntable.

9. A method as claimed in claim 5, wherein at each of said different radial locations, said torque is measured when the direction of a velocity component of the oscillating motion of said top ring is opposite to the direction of a velocity component of the rotation of said turntable.

* * * * *